United States Patent [19]

Krasznai et al.

[11] Patent Number: 4,928,347

[45] Date of Patent: May 29, 1990

[54] VACUUM CLEANER DUST BOWL LATCH AND RELEASE SYSTEM

[75] Inventors: Charles Z. Krasznai, Trumbull; Richard B. Kosten, West Haven, both of Conn.

[73] Assignee: Black & Decker Inc., Newark, Del.

[21] Appl. No.: 294,615

[22] Filed: Jan. 9, 1989

[51] Int. Cl.[5] ..... A47L 5/24

[52] U.S. Cl. ..... 15/344; 15/352

[58] Field of Search ..... 15/344, 339, 352

[56] References Cited

U.S. PATENT DOCUMENTS

| | | | |
|---|---|---|---|
| 4,542,557 | 9/1985 | Levine | 15/344 |
| 4,610,048 | 9/1986 | Ishihara et al. | 15/414 X |
| 4,665,582 | 5/1987 | Richmond et al. | 15/344 |
| 4,821,366 | 4/1989 | Levine | 15/344 |

*Primary Examiner*—Chris K. Moore

*Attorney, Agent, or Firm*—Barry E. Deutsch

[57] ABSTRACT

A dust bowl of a hand-held vacuum cleaner is attached to a power unit using top and bottom latches which are actuated by pushing a single actuator button. Both latches are outside a sealed space through which air flows, and are thus not sources of air, soil of liquid leakage. A wishbone-shaped pusher transmits mechanical actuation forces from the actuator button for actuating the upper latch to a spring bar connected to a bottom latch cam. When the actuator button is pushed, the spring bar is correspondingly moved to release the bottom latch in coordination with release of the top latch. A forward support member of the power unit cradles a portion of the dust bowl to provide support and lateral stability between the elements. A tab extends from the bottom of the dust bowl to overlap a forward edge of the forward support member to provide further stability to the fit.

5 Claims, 5 Drawing Sheets

VACUUM CLEANER DUST BOWL LATCH AND RELEASE SYSTEM

BACKGROUND OF THE INVENTION

1. Field of the Invention

The present invention relates to a vacuum cleaner and, more particularly, to a hand-held vacuum cleaner having a detachable dust bowl.

Vacuum cleaners, especially portable ones, usually include a rigid or semi-rigid dust bowl attached to a power unit. The dust bowl is detachable so that it may be separated from the power unit for emptying.

2. Description of the Prior Art

Prior art vacuum cleaners include a locking mechanism consisting of a combination of an upper latch on the power unit for engaging an opening in the top edge of the dust bowl and fixed projections on the power unit for engaging openings in the bottom edge of the dust bowl. To unlock the dust bowl, it is necessary to first release the latch mechanism and then rotate the front end of the dust bowl in an arc in order to release the top of the dust bowl from the latch, and then to disengage the openings from the fixed projections holding the bottom of the dust bowl. It is not possible to release the dust bowl using a single linear movement.

More positive locking of the dust bowl may be desirable in some designs. For example, in a vacuum cleaner intended for the pickup of liquid, as well as solid materials, improved sealing of the dust bowl to the power unit is required in order to eliminate spillage of the liquid. In addition, such liquid is retained in the dust bowl where its additional weight places greater demands on the latching mechanism. Thus it is desirable to provide a vacuum cleaner having a dust bowl locking mechanism which provides positive locking at both the top and the bottom of a dust bowl. Furthermore, it is desirable to provide for actuation using a single release button for unlocking at both the top and the bottom of the dust bowl with a single push.

SUMMARY OF THE INVENTION

It is an object of the present invention to provide a vacuum cleaner with a dust bowl locking mechanism which allows the removal or insertion of the dust bowl with one straight, linear motion.

It is a further object of the invention to provide a dust bowl locking mechanism providing positive and stable locking at upper and lower edges of a dust bowl.

It is a further object of the invnetion to provide a locking mechanism for locking a dust bowl at its upper and lower edges which is releasable by actuation of a single release button.

It is a further object of the invention to provide a portable wet-dry vacuum cleaner with an easily attachable dust bowl.

It is another object of the invention to provide a vacuum cleaner comprising a power unit and dust bowl in which the power unit includes a support member for supporting the dust bowl.

It is still a further object of the invention to provide a vacuum cleaner with the dust bowl removable or attachable in a single straight linear motion, which is unlocked by a single actuation of a release button.

It is still a further object of the invention to provide a dust bowl release mechanism which releases both top and bottom parts of the dust bowl utilizing a single release means.

It is still a further object of the invention to provide a dust bowl locking and releasing mechanism comprising two latches which are unlocked by pushing a single button.

Briefly stated, the present invention provides a dust bowl of a hand vacuum cleaner that is attached to a power unit using top and bottom latches which are actuated by pushing a single actuation button. Both latches are outside a sealed space through which air flows, and thus the latches and associated structures are not sources of air, soil or liquid leakage. A wishbone-shaped pusher transmits mechanical actuation forces from a latch actuation button actuating the upper latch to a spring bar connected to a bottom latch cam. When the latch actuation button is pushed, the spring bar is correspondingly moved to release the bottom latch in coordination with the release of the top latch. A forward extension of the power unit cradles and supports a portion of the dust bowl to provide lateral and vertical stability to the fit between the elements. A tab extends from the bottom of the dust bowl to overlap a forward edge of the forward extension to provide further vertical stability to the fit.

According to an embodiment of the invention, there is provided a hand-held vacuum cleaner comprising: a power unit, a dust bowl, a first latch effective for securing a first portion of the dust bowl to the power unit, a second latch effective for securing a second portion of the dust bowl to the power unit, the first and second portions being disposed at substantially opposed locations on the dust bowl. Actuating means are provided on the first latch for releasing the first portion of the dust bowl in response to manual actuation thereof, and mechanical interconnection means are provided for operating the second latch in response to the manual actuation of the first latch, whereby coordinated release of the first and second latches is attained.

According to another feature of the invention, there is provided a hand-held vacuum cleaner comprising: a dust bowl, a power unit, latch means for securing the dust bowl to the power unit, a forward support member extending forward from the power unit for supporting at least a portion of the dust bowl. The forward support member includes a top surface and the dust bowl includes a bottom surface wherein the bottom surface of the dust bowl is engaged and supported by the top surface of the forward support member.

According to a further feature of the invention, there is provided a vacuum cleaner comprising: a power unit, a dust bowl, an upper latch coupling an upper portion of the dust bowl to the power unit, a lower latch coupling a lower portion of the dust bowl to the power unit. At least one element of the vacuum cleaner blocks direct connection between the upper latch and the lower latch along an axis of the power unit. Actuation means are provided for releasing the upper latch in response to a mechanical actuation, and connection means are provided for connecting mechanical actuation from the upper latch to the lower latch, whereby the upper and the lower latches are released by the mechanical actuation of the first latch. The actuation means includes a wishbone-shaped pusher, the wishbone-shaped pusher having first and second legs, the first leg passing on a first side of the at least one element, the second leg passing on a second side of the at least one element. Thus the connection means are capable of transmitting actuation force from the upper latch to the lower latch without interference from the at least one element.

The above, and other objects, features and advantages of the present invention will become apparent from the following description read in conjunction with the accompanying drawings, in which like reference numerals designate the same elemtns.

DETAILED DESCRIPTION OF THE PREFERRED EMBODIMENT

Figure 1:
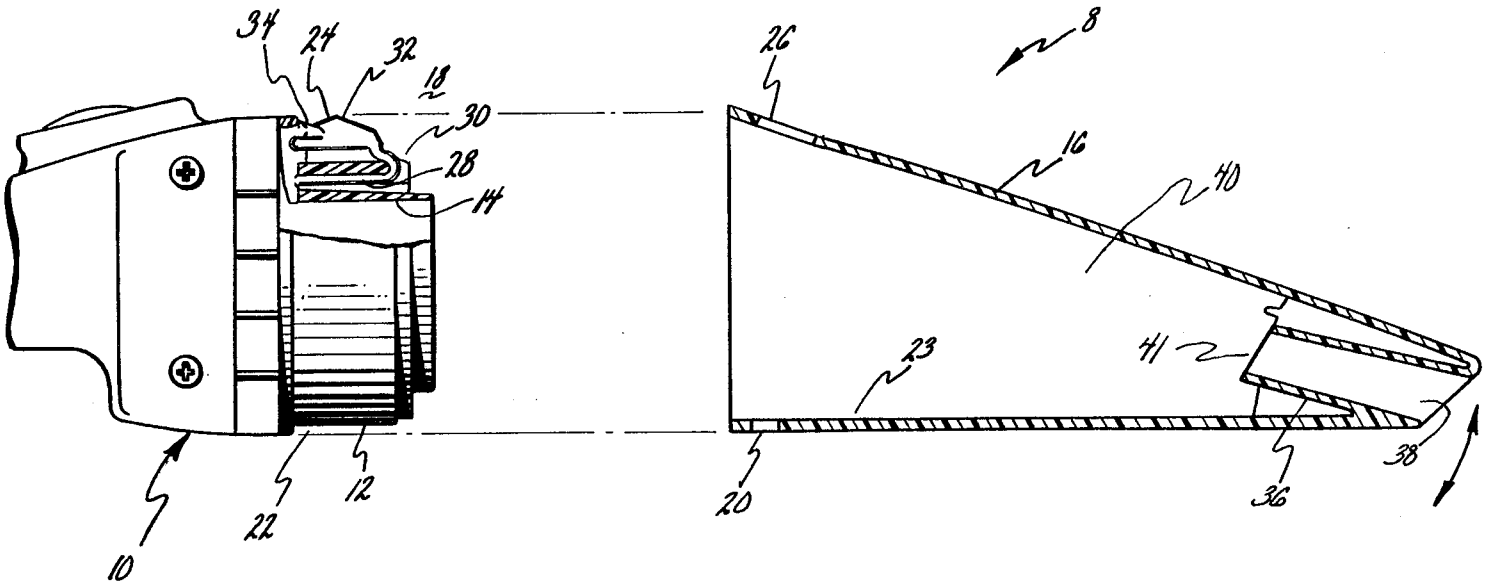
FIG 1 PRIOR ART
FIG. 1 is a vacuum cleaner of the prior art.

Referring to FIG. 1, there is shown, generally at 8, a portable vacuum cleaner according to the prior art. A power unit 10 includes a venturi 12 having a passageway 14 through which air is drawn. A dust bowl 16 is fittable on the front of power unit 10, using a latch mechanism 18, to collect soil drawn thereinto by action of a vacuum produced by power unit 10. Dust bowl 16 is a hollow, one-piece, molded member that is attachable to power unit 10 by the releasable latch mechanism 18. One or more bottom openings 20 in the bottom of dust bowl 16 receive corresponding projections 22 on the bottom of venturi 12. Additional stability is provided by a boss 23 molded in the interior of passageway 40 in a position where it is contacted by a forward edge of venturi 12 when the dust bowl 16 is mated to power unit 10. Latch mechanism 18 includes a flexible latch member 24 carried by venturi 12 which is engageable in an opening 26 of dust bowl 16.

Flexible latch member 24 includes an arm 28 affixed to power unit 10 and a flexible spring 30 connecting arm 28 to a button 32. Button 32 includes a locking shoulder 34 at an end thereof remote from dust bowl 16. Flexible spring 30 tends to urge locking shoulder 34 outward into a latching position. Dust bowl 16 has an air entry chute 36 with an inlet opening 38 integrally molded therewith leading to a dirt-collecting chamber 40. A hinged flap 41 keeps dirt particles from escaping when vacuum cleaner 8 is turned off.

To assemble vacuum cleaner 8, a forward end of dust bowl 16 is tilted downward so that projections 22 can be fitted into bottom openings 20. The forward end of dust bowl 16 is then rotated upward, whereby arm 28 is pushed downward by the upper surface of dust bowl 16 until button 32 passes the forward edge of opening 26. Then, arm 28 snaps outward into opening 26.

Conversely, to remove dust bowl 16 from power unit 10, such as when the dirt is to be emptied from dust bowl 16, button 32 is depressed far enough to release locking shoulder 34 from opening 26. The forward edge of dust bowl 16 is then rotated downward to permit disengagement of bottom opening 20 from projections 22.

Figure 2:
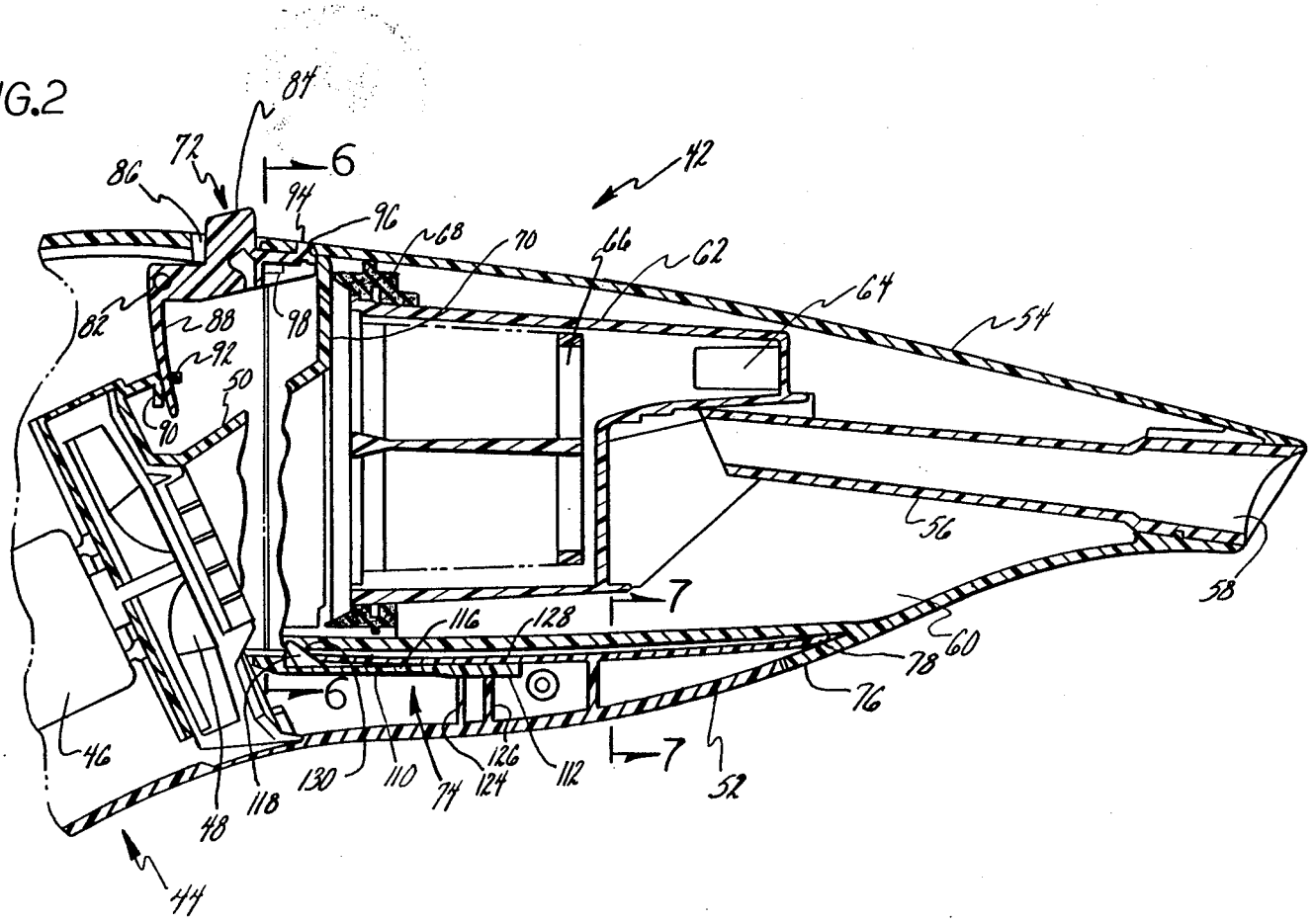
FIG. 2 is a cross-section of a portion of a vacuum cleaner according to an embodiment of the invention.

Referring now to FIG. 2, there is shown, generally at 42, a vacuum cleaner according to an embodiment of the present invention. A power unit 44 contains a conventional electric motor 46 for rotating a fan 48 disposed in the throat of a venturi 50. A forward support member 52, preferably integrally formed with the remainder of power unit 44, extends a substantial distance forward from the bottom wall of the power unit 44. A dust bowl 54 is removably mounted on the forward support member 52, abutting a forward surface of venturi 50. An air inlet chute 56 includes a suction opening 58 formed in the dust bowl 54 for the admission of air drawn therethrough by a partial vacuum produced by rapid rotation of fan 48. A region within dust bowl 54 surrounding air inlet chute 56 forms a liquid trap 60 wherein liquid, entrained in the air, is collected. Air inlet chute 56 extends a substantial distance within dust bowl 54. As is especially valuable in a vacuum cleaner adapted to pick up liquids, the presence of air inlet chute 56 prevents liquid from flowing out of the suction opening 58, regardless of the angle at which the vacuum cleaner 42 is held. A liquid deflector 62 is disposed facing an inner end of air inlet chute 56. An air inlet 64 is positioned in liquid deflector 62 in a location isolated from the direct flow of air leaving air inlet chute 56. A filter 66 is mounted in liquid deflector 62 between air inlet 64 and venturi 50 to filter solid particles from the air stream before such solid particles reach fan 48 and electric motor 46. A seal 68 is disposed about the perimeter of liquid deflector 62 for sealing liquid deflector 62 to the interior of the dust bowl 54, and also for sealing liquid deflector 62 to a forward sealing face 70 of venturi 50. This forces all of the air entering air inlet chute 56 to flow through filter 66 on its way to fan 48.

Since liquid may be collected in liquid trap 60, it is important that a stable, leak-proof connection be established between power unit 44 and dust bowl 54. Briefly, the connection is provided by a lower portion of dust bowl 54 being cradled in and supported by forward support member 52, by an upper latch 72, a lower latch 74, and a tab 76, integrally formed with dust bowl 54, overlapping a forward end 78 of support member 52. In addition to the foregoing, it is desirable to actuate upper latch 72 and lower latch 74 using a single push of an actuation member.

Figure 3:
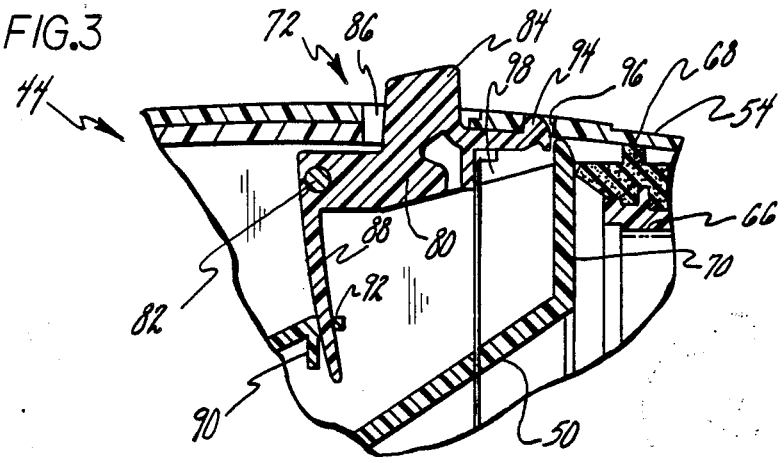
FIG. 3 is an enlarged view of a portion of FIG. 2 which includes the upper latch.

Referring now to the close-up view in FIG. 3, upper latch 72 includes a single, integrally formed locking member 80 mounted in power unit 44 for rotation about a rotation axis 82, indicated by a dashed circle. An actuating member button 84 extends outward through an opening 86 into a position where it is accessible to a user. An integrally formed spring leg 88 extends from locking member 80 into a position where it is held between retaining bosses 90 and 92. A substantial prestress is applied to spring leg 88, whereby locking member 80 is resiliently urged in a counterclockwise direction about rotation axis 82. A latch cam 94 is disposed at a forward end of locking member 80. A latch opening 96 is formed in dust bowl 54 in a position permitting locking entry or engagement of latch cam 94 therein. The resilient urging of spring leg 88 maintains the retention of latch cam 94 in latch opening 96 until released by a positive actuation. It will be noted that latch opening 96 is outside the area sealed by seal 68, whereby air, soil and liquid leaks therethrough are prevented.

Referring again to FIG. 2, it will be noted that venturi 50 is positioned between upper latch 72 and lower latch 74. A structure which avoids the venturi 50 must be provided so that a single push on actuating button or member 84 actuates both upper latch 72 and lower latch 74.

Figure 4:
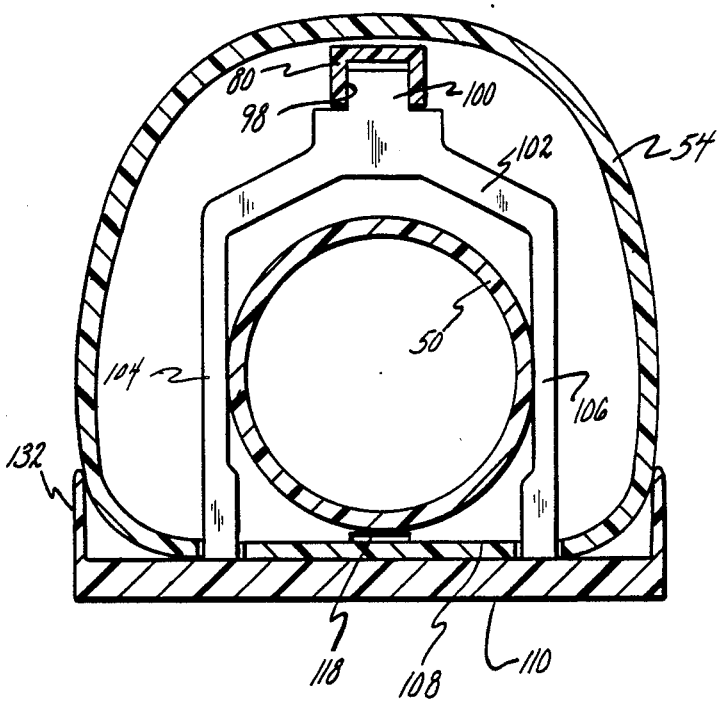
FIG. 4 is a cross-section taken along line IV—IV in FIG. 2.

Referring now to FIG. 4, a nook 98 in locking member 80 receives an actuating tab 100 of a wishbone-shaped pusher 102. First and second legs 104 and 106 extend on opposite sides of venturi 50 and contact an upper surface 108 of a spring bar 110.

Figure 5:
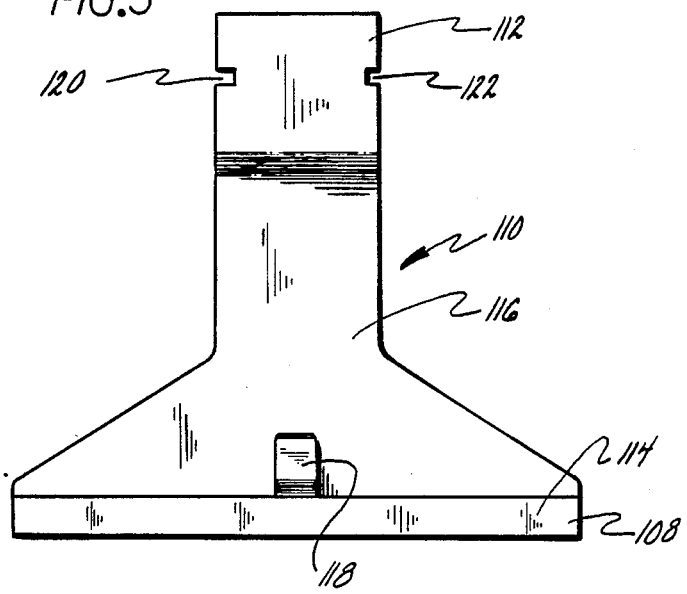
FIG. 5 is a top view of a spring bar of FIG. 2.
Figure 6:
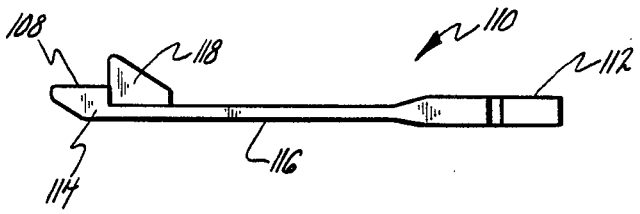
FIG. 6 is a side view of the spring bar of FIG. 5.

Referring now to FIGS. 5 and 6, spring bar 110 includes a clamping section 112, a broad section 114, which includes upper surface 108, and a spring section 116 between clamping section 112 and broad section 114. A latch cam 118 is disposed adjacent upper surface 108. It will be noted that clamping section 112 has a substantially thicker cross-section than does spring section 116. First and second positioning notches 120 and 122 are formed in the edges of clamping section 112 to mate with elements (not shown) for ensuring correct fore-and-aft positioning of spring bar 110 during assembly.

Referring to FIG. 2, first and second webs 124 and 126 contact a bottom surface of clamping section 112, thus securing it against the inside of top surface 128 on forward support member 52. Latch cam 118 is resiliently urged upward into a latch opening 130 in dust bowl 54, whereby the bottom edge of dust bowl 54 is positively retained. The resilient urging of spring section 116 of spring bar 110 provides a positive latch until disconnected by a positive intentional actuation of actuating button 84. It will be noted that latch opening 130 is outside the volume sealed by seal 68. Thus, leakage of liquid or soil through latch opening 130 does not occur.

Figure 7:
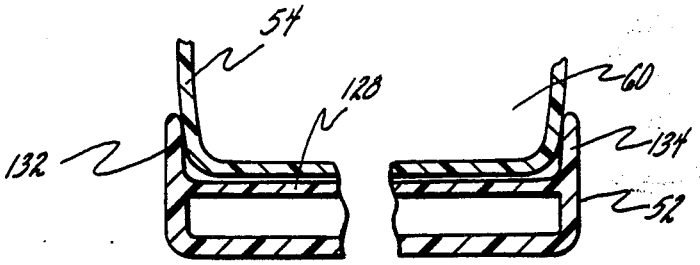
FIG. 7 is a cross-section taken along line VII—VII in FIG. 2.

Referring now to FIG. 7, forward support member 52 includes first and second side rails 132 and 134 extending upward at the lateral extremities of top surface 128 of support member 52. The bottom of dust bowl 54 is cradled and supported in the U-shaped channel thus formed. This provides substantial lateral and vertical stability to the retention of dust bowl 54 and support member 52.

Figure 8:
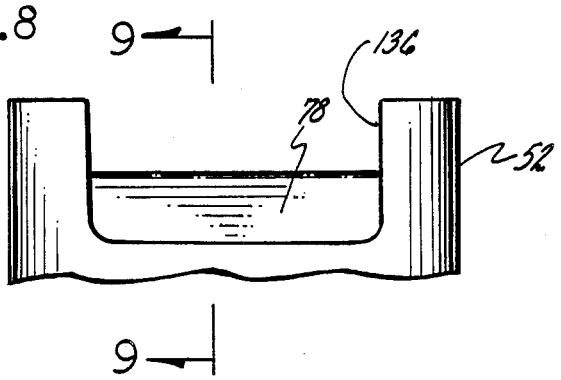
FIG. 8 is an enlarged bottom view of a forward portion of the forward support member of FIG. 2.
Figure 9:
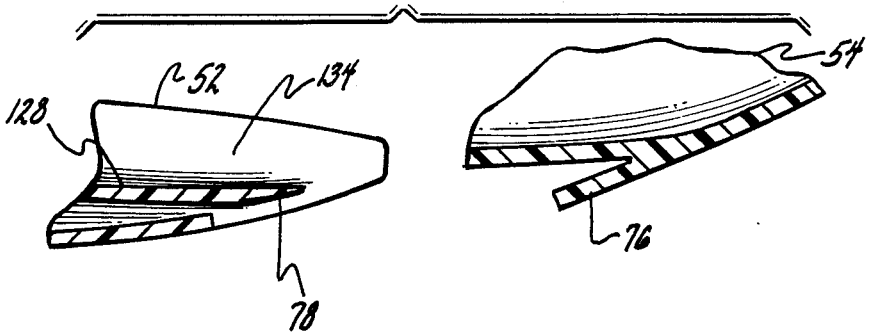
FIG. 9 is a cross-section taken along line IX—IX in FIG. 8.

Referring to FIG. 8, the forward edge of forward support member 52 includes a central notch 136 containing a forward end 78. The width of tab 76 is selected to provide a close fit within the width of central notch 136, whereby lateral stability at the forward end of the fit between dust bowl 54 and support member 52 is enhanced. In addition, as best shown in FIG. 9, the inner shape of tab 76 closely matches the outer shape of forward end 78, upon which it is fitted. Thus, vertical stability at the forward end is also enhanced.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

We claim:

1. A hand-held vacuum cleaner comprising:

a power unit;

a dust bowl;

a first latch means for securing a first portion of said dust bowl to said power unit;

a second latch means for securing a second portion of said dust bowl to said power unit;

said first latch means including actuation means for releasing said first portion of said dust bowl from said power unit, in response to manual actuation thereof;

interconnection means operatively coupling said actuation means to said second latch means for operating said second latch means in response to said manual actuation of said actuation means to thereby release said second portion of said dust bowl from said power unit, whereby coordinated operation of said first and second latches is attained, said interconnection means includes a first member displaced by actuation of said first latch means and at least one leg fixed to said first member and contacting said second latch means for operating said second latch means upon actuation of said first latch means; and said second latch means includes:

a spring bar;

means for clamping a first portion of said spring bar to said power unit, and leaving a second portion thereof free to be displaced against the resilient resistence thereof; and a latch cam fixed to said spring bar for engaging said dust bowl;

wherein said interconnection means includes at least one leg for contacting said spring bar, when actuated by the operation of said actuation means; and wherein an end of said spring bar is displaced by said at least one leg sufficiently to disengage said latch cam from said dust bowl, whereby said second latch means is released and said power unit is released from said dust bowl.

2. A hand-held vacuum cleaner according to claim 1, wherein said first and second portions of said dust bowl are disposed at substantially opposed locations on said dust bowl.

3. A hand-held vacuum cleaner according to claim 1, wherein said at least one leg includes first and second leg members forming, with said first portion, a wishbone-shaped pusher means for actuation of said second latch means.

4. A hand-held vacuum cleaner according to claim 3, wherein said first portion and first leg and said second leg are integrally formed.

5. A vacuum cleaner comprising:

a power unit;

a dust bowl;

an upper latch means for coupling an upper portion of said dust bowl to said power unit;

a lower latch means for coupling a lower portion of said dust bowl to said power unit;

at least one element of said vacuum cleaner positioned between said upper latch means and said lower latch means;

said upper latch means including actuation means and engaging means connected to said actuation means, said engaging means engaging the upper portion of said dust bowl, said actuation means, upon actuation thereof, moving said engaging means out of engagement with said dust bowl thereby releasing the upper portion of said dust bowl from said power unit;

connection means for connecting said upper latch means to said lower latch means, said connection means upon actuation of said actuation means of said first latch means, releasing said lower latch means from engagement with said dust bowl;

said connection means including a wishbone-shaped pusher having first and second leg menas, said first leg means extending on a first side of said at least one element, and said second leg means extending on a second side of said at least one element, whereby said connection means transmits the actuation force on said actuation means from said upper latch means to said lower latch means without interference from said at least one element.

* * * * *